United States Patent [19]

Kanzaka

[11] 4,387,488

[45] Jun. 14, 1983

[54] FABRIC-COVERED BUTTON

[75] Inventor: Yoshihiro Kanzaka, Nyuzen, Japan

[73] Assignee: Yoshida Kogyo K.K., Tokyo, Japan

[21] Appl. No.: 242,608

[22] Filed: Mar. 11, 1981

[30] Foreign Application Priority Data

Mar. 26, 1980 [JP] Japan ..... 55-39973[U]

[51] Int. Cl.[3] ..... A44B 1/12; A44B 1/38

[52] U.S. Cl. ..... 24/113 R; 24/92; 24/108; 24/90 E

[58] Field of Search ..... 24/90 A, 90 C, 90 E, 24/90 R, 92, 104, 108, 113 R, 208 R, 208 A, 216, 213 R, 217 R; 411/508–510, 372, 373

[56] References Cited

U.S. PATENT DOCUMENTS

| | | | |
|---|---|---|---|
| 204,866 | 6/1878 | Wheeler et al. | 24/92 |
| 1,204,159 | 11/1916 | Jaffe et al. | 24/108 |
| 2,649,634 | 8/1953 | Zelenay | 24/113 R |
| 2,685,722 | 6/1951 | Danco | 24/113 R |
| 2,717,434 | 10/1955 | Duell | 24/113 R |
| 3,725,980 | 4/1973 | Burgio | 24/108 R |
| 4,198,733 | 4/1980 | Ferguson et al. | 24/92 |

*Primary Examiner*—Robert Peshock
*Assistant Examiner*—Kris R. Schulze
*Attorney, Agent, or Firm*—Robert E. Burns; Emmanuel J. Lobato; Bruce L. Adams

[57] ABSTRACT

A fabric-covered button includes a button body with a domed head to be wrapped by a piece of fabric, a retainer washer of synthetic resin adapted to fit forcibly over a boss projecting rearwardly from the domed head and to press an edge portion of the fabric piece against a peripheral flange of the domed head, and a fastener having a shank adapted to fit forcibly into an axial hole in the boss. Either the boss or the shank has at least one axial slot which allows air to escape from the hole in the boss when the shank is forced into the hole.

13 Claims, 21 Drawing Figures

FABRIC-COVERED BUTTON

BACKGROUND OF THE INVENTION

1. Field of the Invention

The present invention relates to a fabric-covered button mounted as on a hat.

2. Prior Art

U.S. Pat. No. 2,996,777 patent Aug. 22, 1961 and Japanese Laid-Open Utility Model Publication No. 51-46501 published Apr. 6, 1976 disclose a fabric-covered button comprising a button body having a domed head covered with a piece of fabric and a centrally holed boss, a retainer washer mounted on the base and retaining a marginal edge of the fabric piece against a peripheral flange of the button body, and a fastener having a shank inserted forcibly into the holed boss to secure the button to a piece of cloth. When the shank is forced into the hole in the boss, air is trapped in the hole and compressed therein, exerting an undue force on the button body and the shank. Therefore, the shank cannot enter the boss hole smoothly and the button body tends to be cracked or broken when a muscular effort is made to push the shank into the boss hole.

SUMMARY OF THE INVENTION

A fabric-covered button includes a button body with a domed head adapted to be wrapped by a piece of fabric and having a boss projecting rearwardly from the domed head, a fastener having a base and a shank projecting therefrom and adapted to fit forcibly into an axial hole in the boss to sandwich a piece of cloth between the button body and the fastener base, the boss or the shank having at least one axial slot for allowing air to escape from the boss hole when the shank is forced into the latter. The fabric piece is kept taut over the domed head with an edge portion of the fabric being securely gripped between a peripheral flange of the domed head and an outer periphery of a retainer washer disposed with a force fit over the boss of the button body. The retainer washer comprises an annular rib and a web integral therewith and extending radially inwardly from the rib, the web being thinner than the rib. The retainer washer has a central opening into which the boss is forcibly insertable with the web flexing resiliently.

It is an object of the present invention to provide a fabric-covered button having means for allowing air to escape from a hole in a button body when a shank of a fastener is forced into the hole to sandwich a piece of cloth between the button body and the fastener.

Another object of the present invention is to provide a fabric-covered button having a retainer washer which can be mounted on a boss of the button body resiliently with a force fit.

The above and other objects, features and advantages of the present invention will become apparent from the following description when taken in conjunction with the accompanying drawings, which illustrate preferred embodiments of the present invention by way of example.

DETAILED DESCRIPTION

Figure 1:
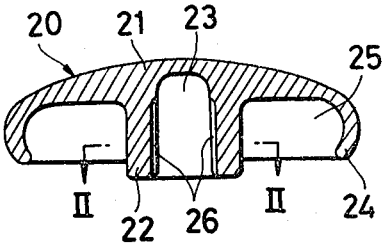
FIG. 1 is a vertical cross-sectional view of a button body according to an embodiment of the present invention.
Figure 2:
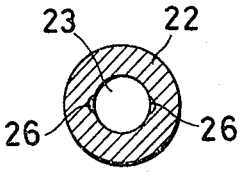
FIG. 2 is a cross-sectional view taken along line II—II of FIG. 1.

As shown in FIG. 1, a button body 20 which is made of metal or preferably synthetic resin comprises a circular domed head 21 having a cylindrical central boss or stem 22 with an axial hole 23 and a reentrant peripheral flange 24 extending annularly in surrounding relation to the central boss 22 with an annular space 25 therebetween. The boss 22 has a pair of diametrically opposite axial slots 26 (FIGS. 1 and 2) opening into the hole 23 and extending axially substantially the full length of the boss 22.

Figure 3:
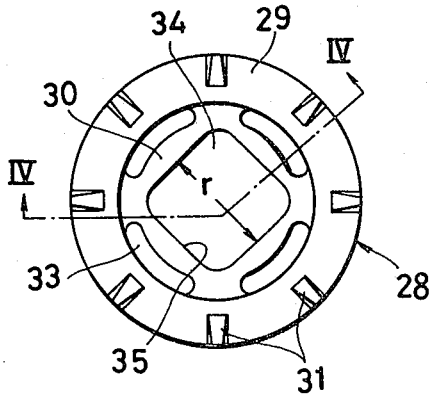
FIG. 3 is a plan view of a retainer washer according to an embodiment of the present invention.
Figure 4:
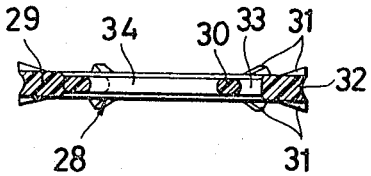
FIG. 4 is a cross-sectional view taken along line IV—IV of FIG. 3.
Figure 3A:
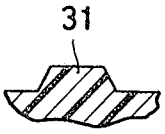
FIG. 3A is an enlarged cross-sectional view of a tooth on the retainer washer shown in FIG. 3.

As illustrated in FIG. 3, a circular retainer washer 28 of synthetic resin comprises an annular rib or ring 29 and an inner web 30 extending radially inwardly from the annular rib 29 and integral therewith, the inner web 30 being thinner than the annular rib 29. On each of the opposite sides of the annular rib 29, there are a plurality of angularly spaced teeth 31 each having an apex and a tapered surface extending radially the full length of the tooth (FIG. 4). As shown in FIG. 3A, each of the teeth 31 is of a cross section of a trapezoid. The annular rib 29 has in its outer periphery a circumferential groove 32. The inner web 30 includes a plurality of angularly spaced slots 33 located adjacent to the annular rib 29. With the inner web 30 thinner than the annular rib 29 and slotted, the inner web 30 is more flexible than the annular rib 29. A substantially square opening 34 is defined centrally in the washer retainer 28 by substantially straight inner edges 35 of the web 30, the diametrically opposite ones of the edges 35 being spaced from each other by a distance of r which is slightly smaller than the outside diameter of the boss 22.

Figure 5:
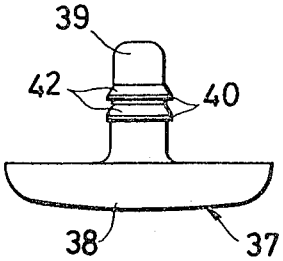
FIG. 5 is a side elevational view of a fastener according to an embodiment of the present invention.

A fastener 37 as illustrated in FIG. 5 which is made of metal or preferably synthetic resin is composed of a circular base 38 and a central shank 39 projecting therefrom. The shank 39 has a pair of annular locking projections 40 extending therearound in tandem relation and each having a peripheral surface 42 tapered toward the distal end of the shank 39. The annular locking projections 40 have a maximum diameter greater than the diameter of the boss hole 23.

Figure 6:
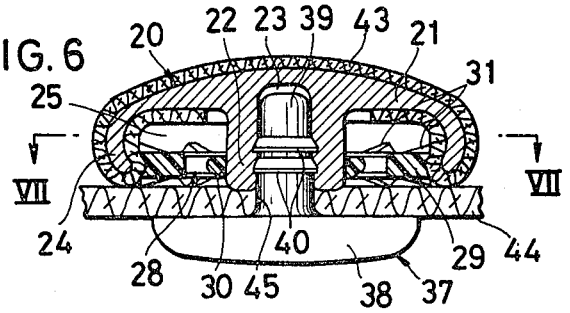
FIG. 6 is a vertical cross-sectional view of a fabric-covered button of the present invention, comprising the button body of FIG. 1, the retainer washer of FIG. 3, and the fastener of FIG. 4.
Figure 7:
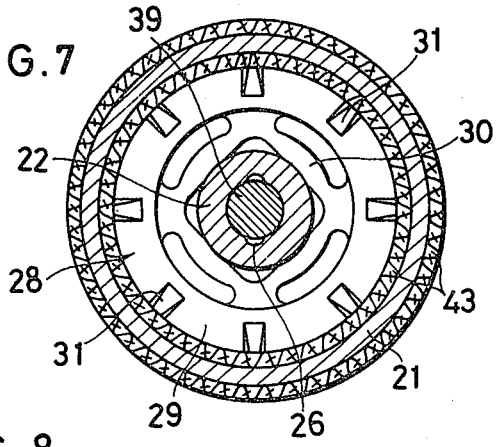
FIG. 7 is a cross-sectional view taken along line VII—VII of FIG. 6.

For assembly, the domed head 21 is wrapped by a piece of fabric 43 (FIG. 6) with its marginal edge portion being tucked into the space 25 around the peripheral flange 24 of the domed head 21. Then, the retainer washer 28 is fitted into the button body 20 such that the inner web 30 is forcibly fitted over the boss 22 with the edges 35 flexing resiliently against the boss 22 and the grooved outer periphery of the retainer washer 28 is snapped over the peripheral flange 24 of the domed head 21 with the fabric piece 43 firmly gripped therebetween. The portion of the fabric piece 43 which is inside the domed bead 21 is retained by the teeth 31 against slipping out. The shank 39 of the fastener 37 is inserted through a preformed aperture 45 in a piece of cloth 44 to which a fabric-covered button is to be attached, and then the shank 39 is fitted forcibly into the hole 23 in the boss 22 until the cloth piece 44 is sandwiched between the base 38 and the button body 20. The slots 26 in the boss 22 allow air to escape out of the hole 23 as the shank 39 enters the hole 23, so that the shank 39 can be pushed into the hole 23 with a relatively small force and no cracks will be developed in the button body 20 during the forced insertion of the shank 39.

Since the retainer washer 28 has its teeth 31 on the opposite sides and is symmetrical with respect to its median plane, the retainer washer 28 is double-faced, that is, the retainer washer 28 is reversible in its application to the button body 21. Accordingly, the retainer washer 28 can easily be assembled with the button body 21 without concern about which direction the retainer washer 28 is facing in. When the fabric-covered button is assembled on the cloth piece 44, the teeth 31 on the then outer face of the retainer washer 28 are held against the cloth piece 44, preventing the button body 20 from rotating thereon.

Figure 8:
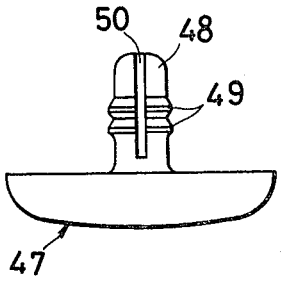
FIGS. 8 through 10 are side elevational views of fasteners according to different embodiments of the present invention.
Figure 9:
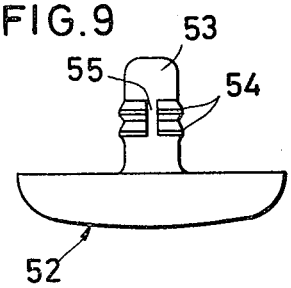
Figure 10:
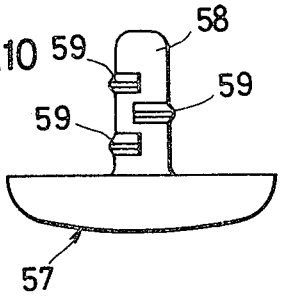

Rather than providing the boss 22 with the slots 26, the shank may have means for allowing air to escape on assemblage of the fastener with the button body. For example, FIG. 8 shows a fastener 47 including a shank 48 having a pair of annular locking projections 49 extending therearound, there being one or more axial slots 50 (only one shown) extending in the shank 48 across the locking projections 49. Another fastener 52 as illustrated in FIG. 9 comprises a shank 53 having a pair of annular locking projections 54 which are interrupted to provide a slot 55 extending axially thereacross. As shown in FIG. 10, still another fastener 57 has a shank 58 around which there are a plurality of arcuate locking projections 59 staggered from each other circumferentially around the shank 58 and spaced from each other axially of the shank 58. With the fasteners 52,57 shown in FIGS. 9 and 10, it is necessary that the shanks 53,58 have a diameter slightly smaller than the diameter of the boss hole into which the shanks 53,58 are to be forced in order to allow air to escape through the slot 55 or a zigzag passage across the locking projections 59.

Figure 12A:
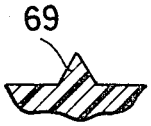
FIG. 12A is an enlarged cross-sectional view of a tooth on the retainer washer shown in FIG. 12.
Figure 11:
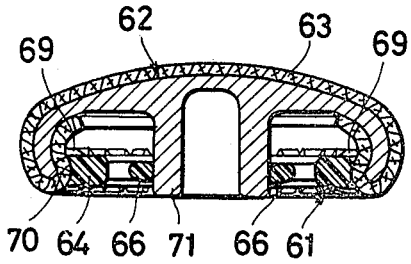
FIG. 11 is a vertical cross-sectional view of a retainer washer according to another embodiment, as combined with a button body.
Figure 12:
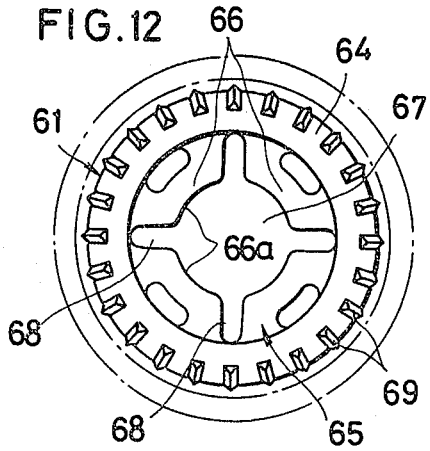
FIG. 12 is a plan view of the retainer washer shown in FIG. 11.

FIG. 11 illustrates another retainer washer 61 combined with a button body 62 to retain a piece of fabric 63 kept taut over the button body 62. As shown in FIG. 12, the retainer washer 61 comprises an annular rib or ring 64 and a radially inward web 65 which is thinner than the annular rib 64 and comprises a plurality of radial tongues 66 that have interrupted inner edges **66*a* jointly defining a substantially circular opening 67, there being a plurality of radial notches 68 each between adjacent ones of the tongues 66. The annular rib 64 has on each of sides thereof a plurality of angularly spaced teeth 69 each in the cross-sectional shape of a triangle as shown in FIG. 12A for engaging and retaining the fabric piece 63 on the button body 62. Upon being assembled, the tongues 66 are forcibly held against a boss 71 of the button body 62. The annular rib 64 has a grooved outer periphery 70 which is snappingly fitted over the fabric piece 63 tucked around a peripheral flange of the button body 62**.

Figure 13:
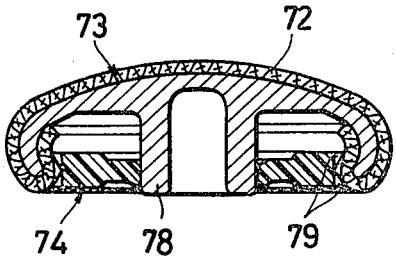
FIG. 13 is a vertical cross-sectional view of a retainer washer according to still another embodiment, as assembled with a button body.
Figure 14:
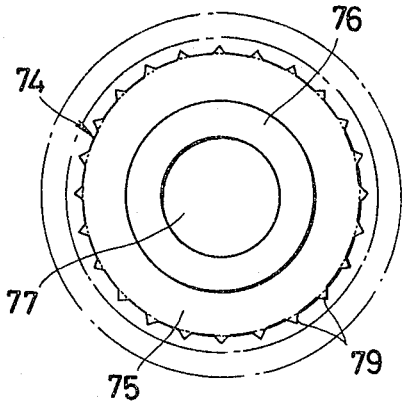
FIG. 14 is a plan view of the retainer washer shown in FIG. 13.

According to another embodiment shown in FIGS. 13 and 14, a piece of fabric 72 is wrapped around a button body 73 and retained thereon by a retainer washer 74 which, as illustrated in FIG. 14, comprises an annular rib or ring 75 and a radially inward annular web 76 defining a circular opening 77 centrally therein, the web 76 being thinner than the annular rib 75. When the retainer washer 74 and the button body 73 are combined together, the web 76 is forcibly fitted over a central boss 78 of the button body 73 for being securely mounted thereon. The retainer washer 74 has on its outer periphery a pair of rows of teeth 79 projecting radially outwardly of the annular rib 75, the teeth 79 being held in biting engagement with a marginal edge portion of the fabric piece 72 which is drawn around a peripheral flange of the button body 73.

Figure 15:
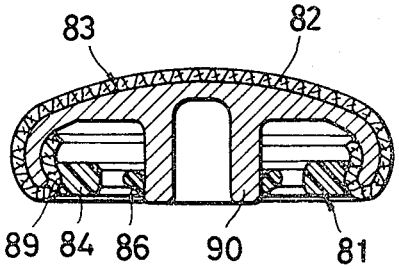
FIG. 15 is a vertical cross-sectional view of a retainer washer according to still another embodiment, the retainer washer being shown to be fitted with a button body.
Figure 16:
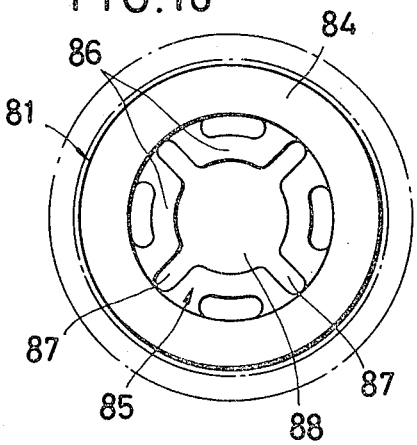
FIG. 16 is a plan view of the retainer washer shown in FIG. 15.

FIG. 15 illustrates still another embodiment in which a retainer washer 81 that keeps a piece of fabric 82 over a button body 83 comprises, as shown in FIG. 16, an annular rib 84 and a radially inward web 85 divided into a plurality of angularly spaced tongues 86 with radial notches 87 therebetween, the tongues 86 jointly bounding a substantially circular opening 88 into which a central boss 90 of the button body 83 is forcibly inserted. The retainer washer 81 has a grooved outer periphery 89 which fits snappingly over the tucked-in portion of the fabric piece 82. The retainer washer 81 as shown in FIGS. 15 and 16 is different from the retainer washer 61 of FIGS. 11 and 12 in that there are no teeth on the annular rib 84 of the retainer washer 81.

The circular openings 67,77,80 shown respectively in FIGS. 12,14,16 should have diameters slightly smaller than the outside diameters of the boases 71,78,90 illustrated in FIGS. 11,13,15, respectively, for forced interfitting engagement between the washers 61,74,81 and the corresponding bosses 71,78,90.

Figure 17:
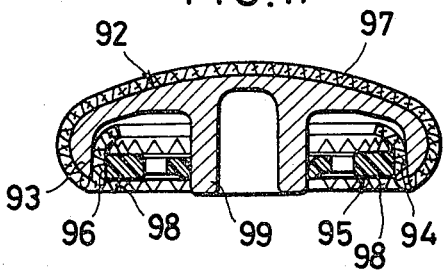
FIGS. 17 through 19 are vertical cross-sectional views of other different retainer washers each shown to be assembled with a button body.
Figure 18:
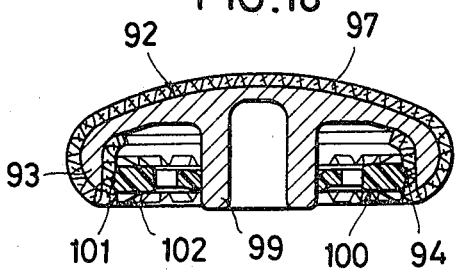
Figure 19:
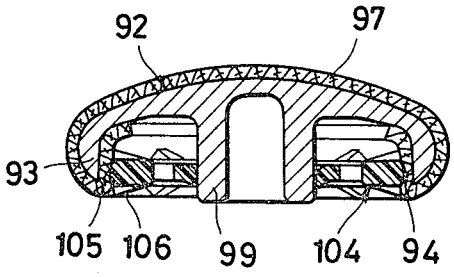

A button body 92 shown in FIGS. 17,18 and 19 includes an annular peripheral flange 93 having an inner surface 94 which extends substantially parallel to a boss 99 or flares slightly. In FIG. 17, a retainer washer 95 has a flat outer periphery 96 which presses a marginal edge of a piece of fabric 97 against the inner surface 94 of the flange 93. The retainer washer 95 has a pair of annular rows of teeth 98 one row on each side of the retainer washer 95, each of the teeth 98 being conical in shape for piercing engagement with the marginal edge of the fabric piece 97 which is tucked in the button 92. FIG. 18 illustrates a retainer washer 100 having on its outer periphery an annular central ridge 101 for pressing engagement with a tucked-in marginal edge of the fabric piece 97. The retainer washer 100 has a pair of annular rows of teeth 102 which are substantially the same in shape as the teeth 69 shown in FIGS. 11 and 12. Likewise, a retainer washer 104 shown in FIG. 19 has a ridged outer periphery 105 and a pair of rows of teeth 106 which however are substantially identical in shape with the teeth 31 as shown in FIGS. 3 and 3A.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A covered button for attachment to a piece of cloth having a preformed aperture, comprising:

(a) a button body including a domed head and a central boss projecting inwardly from said domed head and having a cylindrical outer surface and a cylindrical bore having a continuous circumferential wall and closed at its outer end, said domed head having an inwardly directed peripheral flange surrounding said central boss in spaced relation thereto;

(b) a retainer washer of synthetic resin adapted to be mounted on said boss resiliently with a force fit and having an outer periphery adapted to coact with said inwardly directed peripheral flange of the domed head in gripping between the outer peripheral edge of said washer and a radially inner surface of said flange an edge portion of a piece of fabric extending over said domed head and in around said peripheral flange; and (c) a fastener having a base and a central shank projecting from said base and adapted to fit forcibly into said cylindrical bore in the central boss through an aperture in the piece of cloth to sandwich the piece of cloth between said base and said button body, one of said central shank and said boss having means for allowing air to escape from said bore when said shank is forced axially into said bore, said means comprising a passage extending axially between said shank and boss from the interior of said bore to the atmosphere.

2. A button according to claim 1, said means comprising at least one slot extending axially in said boss and opening into said bore in said boss.

3. A button according to claim 1, said means comprising at least one slot extending axially in said shank of the fastener.

4. A button according to claim 1, said shank having at least one annular locking projection extending therearound.

5. A button according to claim 4, said means comprising an interrupted portion of said annular locking projection.

6. A button according to claim 1, said retainer washer comprising a substantially flat circular plate including an annular rib and a resiliently flexible web integral with said annular rib and extending radially inwardly therefrom, said web being thinner than said annular rib, said circular plate having a central opening into which said boss is insertable.

7. A button according to claim 6, said central opening being substantially square and defined by substantially straight inner peripheral edges of said web, which are forcibly engageable with said boss at outer peripheral portions thereof.

8. A button according to claim 6, said central opening being substantially circular and defined by substantially arcuate interrupted inner peripheral edges of said web, which are forcibly engageable with said boss at outer peripheral portions thereof.

9. A button according to claim 8, said web comprising a plurality of radial tongues angularly spaced from each other.

10. A button according to claim 6, said central opening being circular and defined by a continuous circular inner peripheral edge of said web, which is forcibly engageable with said boss at outer peripheral portions thereof.

11. A button according to claim 6,7,9 or 10, said retainer washer having a plurality of angularly spaced teeth along an outer peripheral edge thereof on both sides of the retainer washer.

12. A button according to claim 6,7,9 or 10, said retainer washer having a plurality of angularly spaced teeth projecting radially outwardly from said outer periphery of the retainer washer.

13. A button according to claim 11, said outer periphery having a peripheral groove extending therearound for receiving partly the edge portion of the fabric piece.

* * * * *